United States Patent [19]

Beltz et al.

[11] Patent Number: 4,705,565

[45] Date of Patent: Nov. 10, 1987

[54] HIGH SPEED STEEL SINTERING POWDER MADE FROM RECLAIMED GRINDING SLUDGE AND OBJECTS SINTERED THEREFROM

[76] Inventors: Robert J. Beltz, 743 Main St.; Joseph D. Dankoff, R.D. #5 Box 19, both of Latrobe, Pa. 15650

[21] Appl. No.: 881,158

[22] Filed: Jun. 25, 1986

[51] Int. Cl.[4] ..... C22C 29/12

[52] U.S. Cl. ..... 75/235; 75/241; 75/242; 75/252; 419/15; 419/19; 419/23; 419/30; 419/33; 419/60

[58] Field of Search ..... 75/252, 235, 241, 242; 419/19, 30, 23, 33, 15, 60

[56] References Cited

U.S. PATENT DOCUMENTS

| | | | |
|---|---|---|---|
| 2,394,578 | 2/1946 | Wulff | 209/214 |
| 3,141,768 | 7/1964 | Bard et al. | 75/235 |
| 3,705,020 | 12/1972 | Nachtman | 75/235 |
| 3,746,518 | 7/1973 | Holtz | 29/182.7 |
| 3,865,629 | 2/1975 | Dankoff et al. | 134/19 |
| 3,997,359 | 12/1976 | Dankoff et al. | 134/10 |
| 4,063,940 | 12/1977 | Dain et al. | 75/213 |
| 4,193,793 | 3/1980 | Cheung | 75/235 |
| 4,464,205 | 8/1984 | Kumar et al. | 148/11.5 |
| 4,464,206 | 8/1984 | Kumar et al. | 148/11.5 |

*Primary Examiner*—Stephen J. Lechert, Jr.
*Attorney, Agent, or Firm*—Nils H. Ljungman

[57] ABSTRACT

A method of producing a sintering powder made from high speed steel and alumina. This sintering powder is sinterable over a broader range of temperatures than conventional high speed steel sintering powders and at lower temperatures, thereby making sintered objects which are crack resistant and also highly wear resistant. Additionally, the sintering powder flows readily when poured into a mold for production of a green object for sintering.

31 Claims, 2 Drawing Figures

Alumina Morphology (unetched, 500X)

Carbide Morphology (Nital Etch, 500X)

HIGH SPEED STEEL SINTERING POWDER MADE FROM RECLAIMED GRINDING SLUDGE AND OBJECTS SINTERED THEREFROM

BACKGROUND OF THE INVENTION

1. Field of the Invention

This invention relates to the production of high speed steel (HSS) powder reclaimed from grinding sludge, and more particularly to such a powder suited for the manufacture of solid components by powder metallurgical processes, such as sintering.

2. Description of the Prior Art

The term "grinding swarf", swarf or grinding sludge, as herein described, refers to a mixture containing typically about 50 to 60% fine metallic particles, about 30 to 35% oil, and about 5 to 15% aluminum oxide abrasive, such as alumina. Grinding swarf is a bi-product produced during the manufacture of tools, such as, high speed steel twist drills as a result of abrasive wheel grinding. Distinction is made between this product, which has an extremely fine, mud-like consistency, and oily chips, which are much coarser.

High speed steels are a family of alloys which contain, in addition to iron and carbon, substantial amounts of the critical carbide-forming components, such as, 0–20% tungsten, 0–10% molybdenum, 0–4% chromium and 0.5–10% vanadium. These steels were originally so named because they could be used as cutting tools in high speed metal machining operations in which the tip of the tool could exhibit a dull red glow from frictional heat during use. Whereas ordinary martensitic carbon steels softened drastically at temperatures in the range of 600° to 1200° Fahrenheit, high speed steels exhibited considerable hot hardness, and therefore the ability to retain a cutting edge in this temperature range. These highly alloyed materials are traditionally melted in electric arc furnaces and cast into ingots which are small in comparison to those used in carbon steel production. This is done to minimize gross alloy segregation, a condition which is prone to occur during freezing of these materials during solidification, which results in coarse segregates of carbides in the finished product.

The development of the powder metallurgical approach with HSS has largely eliminated the problem of coarse carbide segregates. The powder is conventionally produced from a melt by the use of either water or inert-gas atomization jets. Each powder grain becomes, in effect, a micro-ingot, one which cools sufficiently rapidly to prevent the gross alloy segregation found in conventional ingots.

Gas-atomized powder is usually of high purity, especially with regard to low oxygen. However, the particles tend toward a spherical shape and the powder therefore exhibits low green strengths when cold compacted to form shaped items which may later be sintered. Full densification of this powder usually requires that some form of hot deformation be employed, such as, hot isostatic pressing.

Water atomized powder, on the other hand, is usually irregular in shape and can be cold pressed into components with excellent green strength. However, the powder is, unfortunately, much higher in oxygen than is gas atomized powder and must therefore be vacuum annealed in order to lower the oxide content.

Water atomized HSS powder is most frequently cold compacted into a green compact, and then sintered at high temperature under vacuum conditions. When processed in this fashion, the final sintering temperature must be carefully controlled, often to within a temperature range of ±1° Centigrade. If the sintering temperature is too low, sintering is incomplete and voids remain in the final part. Conversely, if the sintering temperature is too high, melting and formation of coarse eutectic carbides occurs.

An example of the prior art is found in U.S. Pat. No. 3,746,518.

An example of swarf treatment is found in U.S. Pat. No. 2,394,578 to Wulff, entitled "Reclamation of Tool Steel Scrap".

OBJECTS OF THE INVENTION

An object of the invention is to broaden the temperature range over which an object may be sintered from a sintering powder.

Another object of the invention is to provide an agglomerate flowable sintering powder having sinterability characteristics normally associated with extremely fine non-flowable powders.

Yet a further object of the invention is to improve the flowability of sintering powder into a mold.

A further object of the invention is to provide a use for swarf from steel grinding to produce sintering powder.

A yet further object of the invention is to maximize the degree of sintering of a sintered object.

Yet still a further object of the invention is to minimize austenitic grain growth during sintering.

Another object of the invention is to improve the resistance to wear of a sintered object by adding alumina to the sintering powder.

Yet another object of the invention is to minimize toughness degradation or crack production in a sintered object from alumina particles.

Still another object of the invention is to minimize carbide particle growth in a sintered object during sintering.

Yet still another object of the invention is to lower the temperature at which sintering will occur in a sintering powder.

Still yet another object of the invention is to improve the grain structure of a sintered object.

SUMMARY OF THE INVENTION

One embodiment of the invention includes a powder for sintering sintered objects therefrom. The sintering powder consists essentially of: steel particles and alumina particles.

Another embodiment of the invention includes a powder for sintering objects therefrom. The sintering powder comprises: ferrous particles, alumina particles and other particles. The ferrous particles are preferably relatively ductile. The other particles are preferably relatively hard. The alumina particles have a sufficiently small size range, such that, when the powder is formed and sintered into an object, crack production arising from the alumina particles in the object is no greater than crack production arising from the other grains in the sintered object.

Still another embodiment of invention includes a method of making a powder for sintering objects therefrom. The method consists of cleaning a swarf resulting from high speed steel grinding and then treating the cleaned swarf to form a sintering powder with predetermined characteristics. The cleaned swarf comprises high speed steel and an abrasive material from a grinding medium used to grind the high speed steel.

Yet another embodiment of the invention includes a method of making a powder for sintering objects therefrom. The method comprises cleaning a grinding sludge, which is comprised of a mixture of high speed steel and abrasive, and reducing the content of the abrasive to a predetermined content in a predetermined range and reducing the size of the particles of the abrasive to a predetermined particle size in a predetermined range.

Still yet another embodiment of the invention includes a sintered object sintered from a sintering powder which comprises steel particles and alumina particles.

DESCRIPTION OF THE PREFERRED EMBODIMENT

Figure 1A:
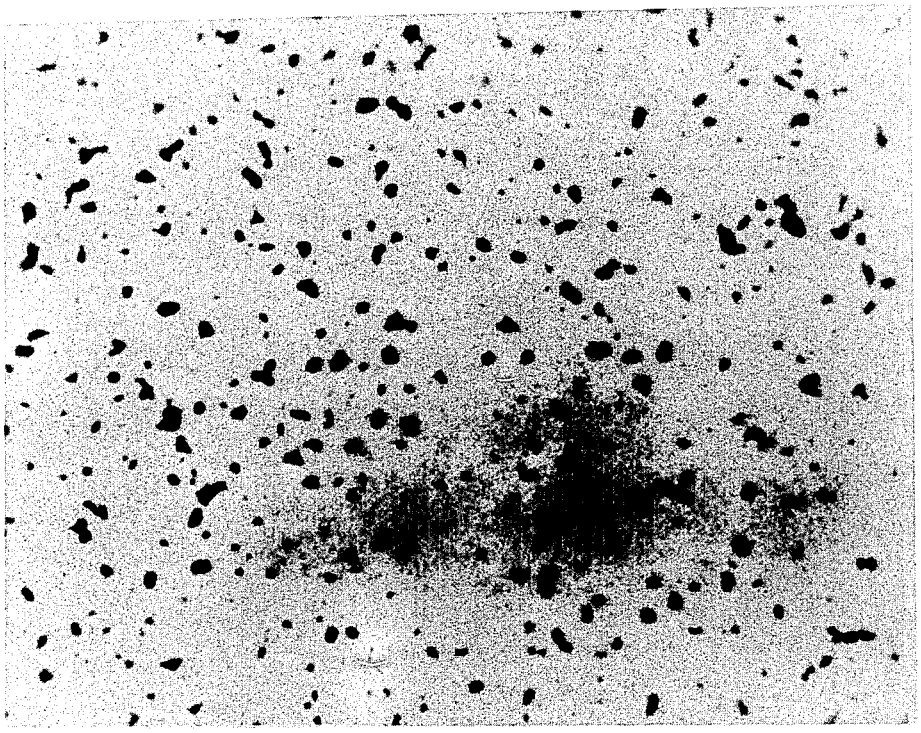
FIG. 1A shows alumina morphology of a sintered sample at 500 times magnification and unetched.

The HSS powder produced according to the methods of the present invention is irregular in shape and is generally finer than that produced by water atomization. This powder, like that produced by water atomization methods, exhibits excellent green strength. It also exhibits excellent sinterability over a wider range of temperatures than one finds for water atomized powders.

Perhaps most noteworthy is the existence in these powders of a fine dispersion of aluminum oxide. This oxide not only imparts improved wear resistance to the material, but also acts to prevent grain growth during high temperature sintering The wider "sintering window" range of temperatures of an embodiment of the present invention is about 10° Centigrade to 25° Centigrade, which is wider than that of a high speed steel of the same composition, but without the aluminum oxide therein as previously mentioned. This decrease in temperature may be associated with the efficacy of grain boundary diffusion mechanisms in the sintering process, though other factors such as the fine particle distribution are likely involved. It is also of interest to note that, and it is believed that, the toughness of the steel probably is not severely diminished by the aluminum oxide because it is believed that the average diameter of the oxide particles is no greater than that of the residual carbides normally found in high speed steel.

The starting raw material for the process according to a preferred embodiment of this invention is the substantially completely deoiled and dried high speed steel powder produced by Kalumetals, Incorporated, P.O. Box 455, Latrobe, Pennsylvania, who produce this product from wet grinding sludge; or the raw material may be produced, for example, according to the methods outlined in U.S. Pat. No. 3,865,629 and U.S. Pat. No. 3,997,359 to Dankoff and Snyder, which patents are incorporated herein by reference as if the entire contents thereof were fully set forth herein. The dried powder, herein referred to as "feed material", usually comprises particles finer than 100 mesh, (U.S.A. Standard Sieve Size) with preferably at least 50% of the weight distribution finer than 325 mesh. The feed material typically contains preferably 2 to 8% of aluminum oxide, and exhibits a carbonaceous residue of cracked hydrocarbon from the original drying operation described in the U.S. patents to Dankoff and Snyder. Moreover, the powder may contain as much as 5% oxygen in the form of a reducible iron-rich oxide. This oxide is, of course, in excess of the stable non-reducible aluminum oxide.

In carrying out an embodiment of the process according to the invention, the feed material to be treated is introduced into a ball mill with a fluid such as isopropal alcohol, naptha, kerosene, or other suitable non-reactive media. The charge is initially ground for a period of one to three hours for the purpose of liberation of any aluminum oxide abrasive particles which may be entrapped within a clump of metallic particles. The slurry comprising the feed and grinding fluid are next introduced into a wet magnetic separator to reduce the alumina to the desired level. Alumina levels below 1% can be achieved depending on the efficiency of the separation process, such as, by dry or wet magnetic separation with a separator made by Eriez Magnetics, Incorporated, Erie, Pennsylvania. However, it has been found that powders with final alumina contents which are in the range of 1 to 5% exhibit excellent sinterability and yield products with an excellent combination of wear resistance and toughness.

At the conclusion of the wet magnetic separation operation, the slurry, comprising the grinding fluid and separated feed material, is reintroduced into the ball mill for additional grinding, usually for a period of time lasting up to 100 hours. The purpose of this second, more prolonged, grinding operation is manifold. First, the metallic particles in the feed can be reduced in size to particles less than five microns in diameter from a starting size in the 50 to 100 micron range. These fine particles are believed to be highly surface active, a circumstance which is believed to promote subsequent sintering. Secondly, with prolonged grinding of up to 100 hours duration, any aluminum oxide particles remaining in the feed after magnetic separation are ground to sizes less than ten microns in diameter. These oxide particles act to prevent excessive grain growth during subsequent sintering and heat treating operations. They are believed to be of the same order of magnitude in size as the residual carbides normally found in high speed steels and, like the carbides, they contribute to wear resistance and to cutting ability. Moreover, the fineness of the oxide particles make them far less deleterious to toughness of the steel products made from the powder made according to an embodiment of the invention, than would the typical 30 to 100 micron size particles found prior to grinding.

A third reason for grinding is that additives, such as, fine tungsten, molybdenum, or vanadium carbide, can be thoroughly milled with the fine feedstock material to provide compositional adjustments in the powder. The feedstock in this sense acts as an excellent "solvent material". After prolonged grinding, it is believed that subsequent high temperature treatment results in significant diffusional homogenization. It is believed that in the resulting high speed steel powder, the original feedstock and alloy additives cannot be differentiated.

Another reason for grinding is that it allows one to control the carbon-oxygen balance in the powder. It has previously been noted that a residual carbonaceous residue from the original swarf processing remains in the feed material. This residue may preferably be as high as 4.5% carbon, but more usually is 3 to 3.5%. In contrast, the final carbon content of high speed steel powder is usually specified in the range 0.80 to 1.2%. One must therefore preferably reduce the carbon content of the feed stock so that the carbon content of the final powder falls within the specified range.

To accomplish the reduction in the oxygen content, it has been found that a controlled amount of oxygen can be added to the powder during grinding. This oxygen can subsequently be made to react with the excess carbon by the heating of the steel under a vacuum so that both the carbon and added oxygen are simultaneously reduced through the formation of carbon monoxide. We have found, for example, that by grinding in appropriate mixtures of isopropal alcohol and water, the oxygen content of the powder can be increased. Such mixtures typically contain between 0 and 5% water in anhydrous isopropal alcohol. The higher the percentage of water in the grinding fluid, the greater the amount of absorbed oxygen in the ground powder.

Oxygen pick-up by the powder during grinding occurs slowly and presumably by means of the following replacement reaction:

$$2Fe+3H_20(liq)\rightarrow Fe_20_3+3H_2(\uparrow)$$

provided that the percentage of water in the alcohol is not appreciably greater than 5%, then the pressure build-up in the ballmill is not excessive and is relieved by means of a pressure relief valve. Fortunately, the above-noted reaction is also endothermic so that uncontrolled temperature build-up is not a problem. The reaction is also self limiting because the oxide coating on the fresh iron surfaces shields the underlying metal from further reaction.

The oxide film also provides another significant advantage. After the powder is subsequently dried after ball-milling the very fine particles ground in the complete absence of water tend to be pyrophoric. However, when water is added to the alcohol, the resultant oxide film formation prevents the pyrophoric behavior. In the event that excessive oxygen is absorbed, one can blend additional carbon into the powder prior to vacuum annealing.

Final grinding, for times up to 100 hours, produces particles with diameters in the 0.5 to 5 micron size range. At the conclusion of the grinding operation, the slurry is discharged into a vacuum drying operation in which the solvent is distilled and collected for reuse.

The dried, finely ground powder is now vacuum treated at high temperature. This is preferably accomplished by heating the powder within a vacuum chamber which can be evacuated to a pressure less than 100 microns. The powder preferably is placed on trays within the vacuum chamber to a depth of about two and one-half inches. Vacuum annealing is preferably accomplished by heating the powder to a temperature in the range of 1000° to 1150° Centigrade for a time ranging from two to six hours.

The purposes of the vacuum treating operation are to provide the proper carbon level and to produce an agglomerated flowable powder. The high temperature treatment under vacuum permits the carbon-oxygen reaction to proceed, thus lowering both the carbon and oxygen content of the steel. The carbon content is thereby reduced from the 3–4% range in the feed material to about 1% in the finished product.

During the annealing operation, caking and agglomeration of the powder bed occurs. These agglomerates are readily broken up by subsequent hammermilling: by careful control of the temperature and time of vacuum treatment, one can achieve a controlled range of particle sizes in the finished product. The final powder granules are therefore larger than the nominal one micron material from the grinding operation, and can be described as being comprised of mini-agglomerates. We have determined that these irregularly shaped agglomerates usually produce a powder of good flowability provided the proportion of powder in the size range less than 37 microns (400 mesh) is not greater than about 30%.

If very fine powder is desired, say for injection molding applications, the mini-agglomerates can be reduced further in size by jet milling.

Finally, the vacuum treatment results in a powder which is mechanically soft and therefore capable of being cold compacted into a green compact with high green strength. This is accomplished by cooling slowly from the maximum treatment temperature through the critical austenite transformation range, less than about 30° Centigrade per hour.

EXAMPLES

EXAMPLE 1

A dried (deoiled) feed material, originally a mixture of M2 type and M7 type American Iron and Steel Institute (AISI) high speed steels being a part of a grinding sludge, has the following analysis:

| Feed Stock Analysis in Percent by Weight | | | | | | |
|---|---|---|---|---|---|---|
| C | Mo | W | Cr | V | O* | Alumina ($Al_2O_3$) |
| 3.7 | 6.6 | 3.2 | 3.7 | 1.7 | 4.0 | 2.5 |

*The oxygen percentage (4.0) specifically refers to the reducible oxygen. This value was estimated by subtraction of the theoretical oxygen content of aluminum oxide from a measured total oxygen value. Moreover, it is the oxygen value after grinding.

| Screen Analysis | |
|---|---|
| Sieve Size | Cumulative % |
| +100 (147μ) | 6.1 |
| +150 (104μ) | 12.6 |
| +200 (74μ) | 22.1 |
| +400 (37μ) | 49.2 |
| where μ is equal to a micro meter | |

The aluminum oxide abrasive component (2.5 percent by weight) consisted primarily of particles in the −100 to +400 mesh (37 to 140 microns) range. Whereas this component was generally blocky in nature, the steel particles were patently non-spherical, comprising in the main of non-flowable spicular particles with curled end.

It was desired to produce from this feed material an analysis with a tungsten:molybdenum ratio characteristic according to AISI M3 HSS, published by the American Iron and Steel Institute. This could be accomplished by raising the tungsten content to the 6 to 6.5% range. A further consideration is the vanadium content, which in standard M3 is about 3%. However, owing to the large volume of hard, second-phase particles in consideration of the alumina as well as vanadium carbides, the vanadium content was raised only to the 2% level.

The following charge was added to a nominal 14 inch diameter by 19 inch ball mill, for example, made by Paul O. Abbé Incorporated, 2395 Center Avenue, Little Falls, N.J.

Feed Material: 45 pounds
Vanadium Carbide: (−325 mesh) 0.18 pounds
Tungsten Metal (1.25 microns): 1.40 pounds Graphite: 0.33 pounds
Isopropanol: 6 gallons
Water: 1 liter The charge was ground for a period of 96 hours. At the conclusion of this operation, the slurry, comprising finely ground feed material and additives suspended in alcohol, was discharged into trays for drying. Heat lamps were used to evaporate the alcohol. During the running of this example, no attempt was made to collect the alcohol. During commercial exploitation, an economical production operation would require its collection and preferable reuse.

At this point, the dried powder comprised mainly steel particles of diameters generally in the 0.5 to 10 micron range. In addition, the powder comprised about 2.5 percent by weight of finely dispersed aluminum oxide. Whereas, before grinding, the aluminum oxide had particles mainly in the 50 to 150 micron diameter range, the aluminum oxide after grinding comprised particles generally in the 1 to 10 micron range and preferably in the 1 to 5 micron range and even in the 3 to 10 micron range.

A sample of the dried powder weighing approximately one and one-half pounds was slowly heated in a vacuum tube furnace to a temperature of 1050° Centigrade, was held for a period of one hour, and finally was heated to 1125° Centigrade and held for 30 minutes. The powder was then slowly cooled through the critical austenite transformation range and then cooled more rapidly to room temperature by bleeding inert gas into the furnace tube.

The powder, after vacuum annealing, was comprised of sintered agglomerates which readily broke down by passing the sintered lumps through a Raymond Hammermill made by the Raymond Company. With only a single pass through the mill, only about 10% of the material was larger than 100 mesh (150 microns). Almost all of the coarse fraction readily broke down into particles of size smaller than 100 mesh during a subsequent pass through the hammermill. The powder granules were macroscopically blocky in nature, but were comprised of a fine scale of sintered fines.

Whereas, the original feed material, both before and after grinding, was completely non-flowable, the powder after vacuum annealing and hammermilling exhibited good flowability. The flowability, as measured by the Hall flow test, the apparent density, the screen analysis, and the final chemical analysis are as follows:

| Chemical Analysis in Percent by Weight | | | | |
|---|---|---|---|---|
| W | Mo | Cr | V | C |
| ← 6.4 | ← 6.5 | ← 3.9 | ← 2.0 | ← 0.95 |

| Apparent Density | Hall Flow |
|---|---|
| 2.3 gm/cc | 36 (Sec/50 gm) |

| Screen Analysis | |
|---|---|
| Sieve Size | Cumulative % |
| +100 | Nil |
| +140 | 15 |
| +200 | 32 |
| +400 | 62 |

A sample of the above powder was compacted in a 0.379 inch diameter cylindrical die at a pressure of 50 tons per inch squared. Green density of the piece was 5.92 grams per cubic centimeters (gm/cc) or approximately 75% of the the theoretical maximum density of 7.9 gm/cc calculated for the 2.5% alumina alloy.

The green compacted cylindrical sample was next sintered in a vacuum type furnace at 1240° Centigrade for approximately one hour. After cooling from the sintering temperature, the density of this sample was measured to be 7.86 gm/cc, or about 99.5% of theoretical density. Drillings taken from the sample were analyzed and determined to have a carbon content of 0.80%, whereas the original carbon content of of the powder was 0.95%. The loss in carbon apparently arises because of the presence of a small amount of residual oxygen in the powder prior to vacuum sintering. During the vacuum sintering operation, carbon reacts with this residual oxygen, and is evolved in the form of carbon monoxide gas. An example of sintering technology is found in U.S. Pat. No. 4,063,940, which patent is incorporated herein by reference as if the entire contents thereof were fully set forth herein.

In order to compensate for the carbon loss during vacuum sintering, approximately 0.20% graphite was dry blended into the powder before die compaction. Test samples were again compacted and sintered in a fashion identical to that discussed in Example 1. With this sample it was determined that full density, 7.9 gm/cc, could be achieved by vacuum sintering for one hour at a temperature of about 1230° Centigrade.

Metallographic examination at 500 times magnification of polished cross sections of the sintered components revealed a uniform dispersion of alumina, as shown in FIG. 1A. A rigorous analysis of particle size statistics was not undertaken, but the mean diameter of the alumina particles was observed to be clearly well under ten microns.

Figure 1B:
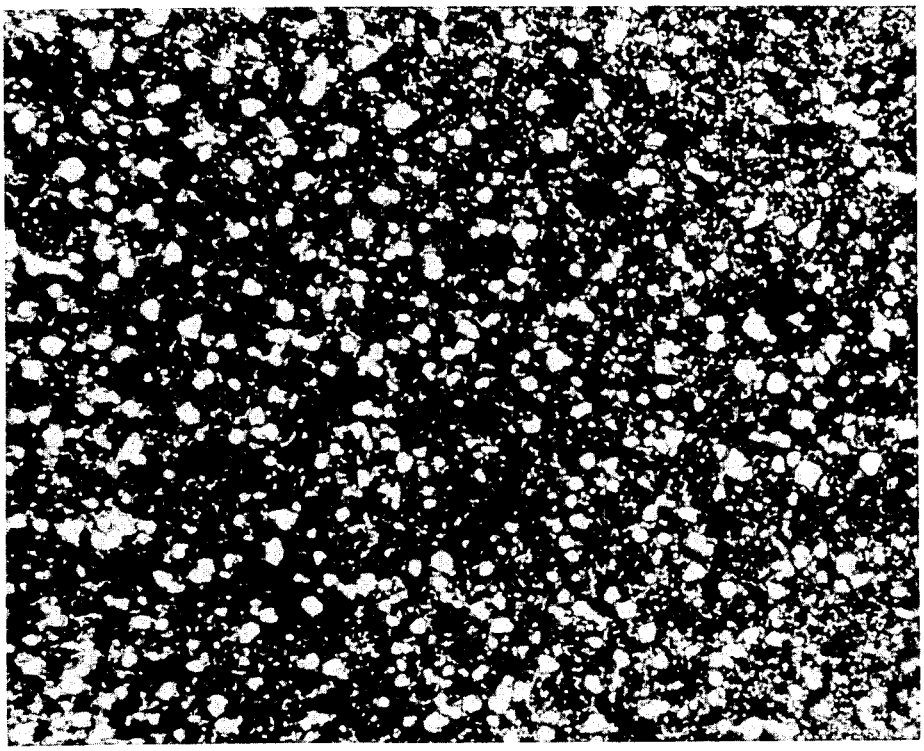
FIG. 1B shows carbide morphology of a sintered sample at 500 times magnification and etched with a Nital etch.

The residual carbides were revealed by etching the polished cross sections in alcohol with 10% nitric acid. These carbides, as shown in FIG. 1B, were also well dispersed and with a mean diameter well under ten microns.

EXAMPLE 2

A one and one-half pound sample of the "as ball-milled" charge described in Example 1 was treated under vacuum as follows: the sample was heated to 1050° Centigrade, held one hour, heated to 1090° Centigrade, held one hour, and finally heated to 1100° Centigrade and held 30 minutes. The powder was then cooled in the same manner as described in the previous example.

Because of the lower treatment temperature during vacuum processing, the sintered lumps, in this case, were more readily disintegrated than was the material described in Example 1. After a single pass through a Raymond Hammermill, all but an insignificant fraction of the powder was in the size range below 100 mesh Screen analysis, apparent-density, and Hall Flow are as follows:

| Screen Analysis | |
|---|---|
| Sieve Size | Cumulative % |
| +100 | Nil |
| +150 | 8 |
| +200 | 18 |
| +400 | 38 |

| Apparent Density | Hall Flow |
|---|---|
| 2.1 gm/cc | Nil (sec/50 gm) |

Chemical analysis of the resulting powder was similar to that found in Example 1 except that the carbon content was 1.02% as compared with 0.95% in Example 1 Evidently, the lower treatment temperature during vacuum processing not only resulted in less agglomeration, but also in somewhat more incomplete reaction between carbon and oxygen.

A sample of this powder was compacted in a cylindrical die at a pressure of 50 tons per square inch (tons/in$^2$) Green density of the piece was 5.86 gm/cc or about 74% of theoretical density. The green compacted cylindrical sample was next sintered in a vacuum furnace at 1240° Centigrade for approximately one hour. After cooling from the sintering temperature, the density of this sample was 7.90 gm/cc or 100% of theoretical density. Drillings taken from this sample were analyzed and determined to have a carbon content of 0.82%, a value very nearly equal to that found in the corresponding sintered sample of Example 1

In order to compensate for the carbon loss during sintering, approximately 0.2% graphite was dry blended into the powder before die compaction. With this sample it was found that full density (7.90 gm.cc) could be achieved by sintering at a temperature as low as 1220° Centigrade.

As illustrated in the two examples heretofore presented, particle size of the final powder is strongly influenced by the temperature at which the vacuum processing is carried out. The finer the powder, the poorer is the flowability. However, sinterability of the very fine powders is better than the coarser powder as is evident from a comparison of the sintering temperatures required for complete densification of cold compacted samples in Example 1 and 2. Hot isostatic pressing could also be used.

EXAMPLE 3

A lower carbon variation of the powder described in Example 1 was compacted at 50 tons/in$^2$ and vacuum sintered to form a rectangular block 3"×1"×0.5". The alloy, after sintering, contained 0.72% carbon and 2.5% alumina. The block was heat-treated with standard high speed steel salt bath methods to a hardness of Rockwell C 64. A block of similar dimensions was cut from a bar of AISI M2 high speed steel obtained from a conmercial source. This block was also salt bath heat treated to a hardness of Rockwell C 64.8. Both blocks were subjected to a Dry Sand/Rubber Wheel Abrasive Wear Test according to the American Society of Testing and Material (ASTM) specification G65. In this test a 0.5" thick hard rubber nine inch diameter wheel loaded at 30 pounds was rotated against a wear block while dry sand was fed into the contact zone. The alumina containing alloy was compared against the standard M2 alloy. Results of weight loss measured after 2000 and 6000 revolutions are presented in the following table:

ABRASIVE WEAR BEHAVIOR
OF 2.5% ALUMINA HSS AND WROUGHT AISI M2
Test Procedure: ASTM G65

| Test Sample | Hardness Rockwell C (Rc) | Volume Loss-mm3 2000 Rev | Volume Loss-mm3 6000 Rev |
|---|---|---|---|
| 2.5% Alumina Alloy (0.72% C) | 64.0 | 4.1 | 18.0 |
| AISI M2 (0.82% C) | 64.8 | 11.9 | 25.0 |

Alternatively, a low alumina content grinding sludge can be used, thus eliminating the step of reducing the alumina content.

The invention as described hereinabove in the context of the preferred embodiments is not to be taken as limited to all of the provided details thereof, since modifications and variations thereof may be made without departing from the spirit and scope of the invention.

What is claimed is:

1. A powder for sintering sintered objects therefrom, said sintering powder consisting essentially of:

high speed steel particles: and alumina particles.

2. The sintering powder according to claim 1 wherein said steel particles and said high speed alumina particles form an agglomerate having granules comprising a mixture of said steel particles and said high speed alumina particles.

3. The sintering powder according to claim 2 wherein said steel particles have a size range which is so fine that if said high speed particles were individually separate from one another they would cake and not flow freely if said fine high speed steel particles were poured from a container into a mold used for compression of sintering powder into a green sinterable object.

4. The sintering powder according to claim 2 wherein said agglomerated granules being of such a size range that said agglomerated granules flow, more readily and more smoothly than said fine high speed steel particles, if individually separate, whereby said agglomerated granules substantially readily and substantially smoothly flow when poured from a container into a mold for compression of said sintering powder into a green sinterable object.

5. The sintering powder according to claim 4 wherein said alumina particles have a size of less than about 10 micrometers in diameter.

6. The sintering powder according to claim 5 wherein said alumina particles have diameters greater than about 1 micrcmeter

7. The sintering powder according to claim 4 wherein said agglomerated granules have diameters less than about 250 micrometers.

8. The sintering powder according to claim 4 wherein said high speed steel particles have a range of diameters less than about 15 micrometers.

9. The sintering powder according to claim 8 wherein said high speed steel particles have a range of diameters greater than about 0.5 micrometers.

10. The sintering powder according to claim 1 wherein said alumina particles are in a proportion with respect to said high speed steel particles and have characteristics such that sinterability of said powder is substantially maximized.

11. A powder for sintering objects therefrom, said sintering powder comprising:

ferrous particles, alumina particles and carbide particles;

said alumina particles having a sufficiently small size range such that when said powder is formed and sintered into an object crack production from said alumina particles in said object is no greater than crack production from said carbide particles in said sintered object.

12. A powder for sintering objects therefrom according to claim 11 wherein at least a major portion of said alumina particles have diameters no greater than the diameters of said carbide particles.

13. A powder for sintering objects therefrom according to claim 12 wherein said ferrous particles comprise high speed steel.

14. A powder for sintering objects therefrom according to claim 10 wherein said alumina particles are present in a proportion such that the temperature range in which sintering substantially occurs is at least about 15° Centigrade.

15. A powder for sintering objects therefrom according to claim 14 wherein said temperature range of sintering of said sintering powder when being sintered, is at least about 10° Centigrade.

16. A powder for sintering objects therefrom according to claim 1 whereby said alumina particles have a concentration and have physical properties to minimize grain growth in the sintering powder when being sintered, such that, the sintering temperature is minimized, whereby said grain growth is of austenitic grains and is minimized in said object during sintering.

17. A powder for sintering objects therefrom according to claim 14 wherein the portion of alumina particles in said sintering powder is substantially less than the portion of high speed steel therein;

said portion of said alumina particles being present in said sintering powder in a predetermined magnitude to substantially increase wear resistance of a finished sintered object made from said powder over wear resistance of a sintered object made from another high speed steel powder having a portion of alumina. particles substantially less in quantity than said object made from said sintering powder.

18. A powder for sintering objects therefrom according to claim 17 wherein said portion of said alumina particles comprises no more than about 10 percent by weight of said sintering powder.

19. A method of making a powder for sintering objects therefrom, said method comprising the steps of:

(a) cleaning a swarf ground from high speed steel, said cleaned swarf comprising high speed steel and an abrasive material from a grinding medium used to grind said high speed steel; and (b) mechanically and thermally treating said cleaned swarf produced in step (a) to form said sintering powder with predetermined characteristics.

20. A method of making a powder for sintering objects therefrom according to claim 19 wherein said treating comprises:

(c) classifying said clean swarf to produce a mixed powder having particle sizes substantially under a first, substantially predetermined, particle size range, said powder containing trapped alumina particles therein; and (d) mechanically treating the cleaned swarf of step (c) to break up at least a portion of alumina particles trapped within said high speed steel.

21. A method of making a powder for sintering objects therefrom according to claim 20 wherein said mechanical treating further comprises:

(e) reducing sizes of at least a portion of the particles produced in step (d) such that at least the largest alumina particles therein are substantially reduced to a yet smaller predetermined size range than the corresponding particles produced in step (c).

22. A method of making a powder for sintering objects therefrom according to claim 19 wherein said cleaning of said swarf comprises at least oil removal.

23. A method of making a powder for sintering objects therefrom according to claim 19 whereby said treating of said clean swarf in step (b) comprises vacuum heat treating.

24. A method of making a powder for sintering objects therefrom according to claim 19 wherein said treating of said clean swarf produced in step (b) comprises softening said powder.

25. A method of making a powder for sintering objects therefrom according to claim 19 wherein said treating comprises agglomerating said high speed steel and said abrasive material.

26. A method of making a powder for sintering objects therefrom according to claim 19 wherein said abrasive material comprises alumina.

27. A method of making a powder for sintering objects according to claim 19 wherein said swarf comprises carbide particles and said treating includes:

adjusting the size of said alumina particles so that said alumina particles in said resultant sintering powder are not substantially greater in size than said carbide particles.

28. A method of making a powder for sintering objects therefrom, said method comprising the steps of:

(a) cleaning a grinding sludge comprising a mixture of high speed steel and abrasive: and (b) reducing the content of said abrasive to a predetermined content in a predetermined range and reducing the size of the particles of said abrasive to a predetermined particle size in a predetermined range.

29. A method of making a powder for sintering objects therefrom according to claim 28 including agglomerating said abrasive particles of step (b) and said high speed steel to form an agglomerated sintering powder which is flowable when poured from a container into a mold for compression of said sintering powder into a green sinterable object.

30. A method of making a powder for sintering objects according to claim 29 wherein said abrasive is alumina.

31. A substantially full density sintered object sintered from a sintering powder comprising:

high speed steel particles: and alumina particles.

* * * * *